United States Patent [19]

Tietz

[11] 4,221,121

[45] Sep. 9, 1980

[54] MULTI-LEVEL LOCK SYSTEM AND METHOD

[75] Inventor: Werner Tietz, Berlin, Fed. Rep. of Germany

[73] Assignee: Zeiss Ikon AG. Goerzerk, Fed. Rep. of Germany

[21] Appl. No.: 940,787

[22] Filed: Sep. 8, 1978

[51] Int. Cl.[2] ..... E05B 27/06

[52] U.S. Cl. ..... 70/358; 70/364 A; 70/378; 70/421

[58] Field of Search ..... 70/358, 364 A, 364 R, 70/376, 378, 419, 421

[56] References Cited

U.S. PATENT DOCUMENTS

| | | | |
|---|---|---|---|
| 3,479,849 | 11/1969 | Check | 70/378 |
| 3,742,744 | 7/1973 | Lumme | 70/358 |
| 4,107,966 | 8/1978 | Schlage | 70/364 A |

FOREIGN PATENT DOCUMENTS

| | | | |
|---|---|---|---|
| 1553529 | 4/1970 | Fed. Rep. of Germany | 70/378 |

*Primary Examiner*—Robert L. Wolfe

*Attorney, Agent, or Firm*—Hill, Van Santen, Steadman, Chiara & Simpson

[57] ABSTRACT

Apparatus and method for a secure multi-level key system. A multi-level key system utilizes ribs of known width upon the higher level keys to properly displace obstruction pins corresponding to selected locking pins of the lock housing. A two-part cylinder pin is utilized in order that a higher level key may equalize the spring-biased locking pin with a shallower groove than is necessary for a subordinate key to equalize the same locking pin. The obstruction pins sense the presence or absence of the ribs associated with the high order keys. Subordinate keys, lacking ribs, depend on the additional displacement of the cylinder pin to properly position the obstruction pins to unlock the lock. Creation of a higher order key requires a two-step process of reducing the depth of the groove corresponding to a given cylinder pin of the lock as well as building up the ribs required to offset the obstruction pins associated with the same cylinder pin of the lock.

6 Claims, 6 Drawing Figures

MULTI-LEVEL LOCK SYSTEM AND METHOD

BACKGROUND OF THE INVENTION

1. Field of the Invention

The field of the invention is that of locks having multiple levels of keys such that some keys may open more locks than other keys.

2. Prior Art

It has been a problem with some multiple level key systems that higher level keys may be produced from lower level keys by removing lateral profile ribs on the lower level or subordinate keys. This technique works in installations where the higher level keys are distinguished by means of diminishing numbers of profile ribs compared with lower level keys. In order to prevent a key with a filed-away rib from being used as a higher level key, a profile lock in accordance with German Pat. No. 15 53 529 may be used. This lock consists of one or more laterally scanning locking pins which are positioned in bores of the rotary cylinder and are positioned with their outer edges corresponding to the perimeter of the rotary cylinder only when the key profile currently inserted in the lock has the predetermined size. If this profile width is reduced or completely lacking, then the locking pins are displaced a lesser amount and an obstruction of the lock occurs whereby after beginning to rotate the cylinder core, the spring-biased housing pin corresponding to that pair of scanning pins will drop into the bore occupied by one of the scanning pins which has been left partially opened due to the imperfect position of the scanning pins.

There has been a need for a simple though more secure means of safeguarding against unauthorized production of high level keys from subordinate keys.

BRIEF SUMMARY OF THE INVENTION

The invention comprises a lock consisting of a housing and a rotary cylinder adapted for the receipt of flat keys. Within the cylinder, additional blocking pins are associated with one or more of the cylinder pins and are located at an angle with respect to the spring-loaded housing pin associated with each cylinder pin. The obstructing or blocking pins sense the profile size of the key which has been inserted and for a given predetermined profile size are urged outwards so that their outer ends correspond to the perimeter of the cylinder.

An improper key will have a reduced profile and the obstructing pins will not be urged far enough outward from the center of the cylinder so as to have their ends reach the perimeter of the cylinder. As a result, after the cylinder begins to rotate in the case of an improper profile, the spring-loaded housing pin may drop into the bore of an obstruction pin and block further rotation of the cylinder.

The proper higher order keys at the scanning or sensing location near the obstructing pins have a flat groove as well as an associated rib which provides the proper width. The rib or ribs are adapted to push against or push back the obstructing pins to the perimeter of the cylinder. When the obstructing elements are contacted by the spring-biased locking pin, the ribs of the key hold the obstructing pins against the outer perimeter of the cylinder thereby blocking the housing pin from entering the bore in the cylinder.

A subordinate key is provided at the proper scanning point with a deeply cut groove without having the necessary ribs. However, the cylinder pin has a diameter which is wide enough to drive the front surface of each of the blocking pins in the cylinder to the outer edge of the cylinder thereby holding the spring loaded locking pin out of the cylinder which is then free to rotate.

Because the lower level keys must allow the cylinder pin to rise higher in the cylinder bore than does a higher level key, a two part cylinder pin is utilized. One unlocking point of the cylinder pin corresponds to the displacement due to inserting the higher level key into the lock. A second unlocking point of the cylinder pin corresponds to the displacement of the lower level key.

Thus, a person attempting to make a higher level key must not only adjust the key to displace the cylinder pin properly, but the key must have the correct cross-section so that the obstruction pins are properly displaced in the cylinder.

DETAILED DESCRIPTION OF THE PREFERRED EMBODIMENT

Figure 1:
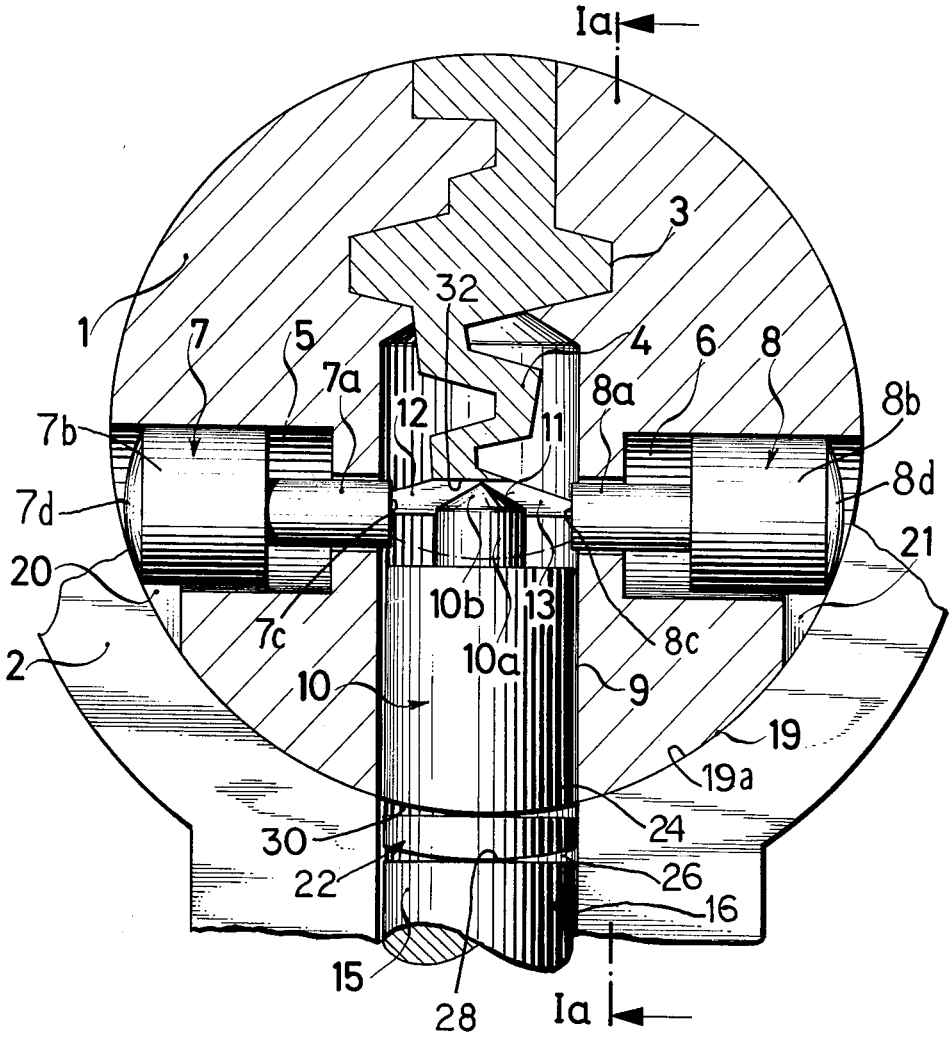
FIG. 1 is an enlarged partial section of a typical cylinder showing the obstruction pins and the two part cylinder pin of the present invention.

While the principles of the present invention find a particular utility in a multi-level cylinder lock, it will be understood that the combination of obstruction pins and two-part cylinder pins of the present invention may be utilized in other combinations. By way of exemplary disclosure of the best mode of practicing the invention, there is shown generally in FIG. 1 a cylinder 1 rotatably mounted within a lock housing 2. The cylinder 1 has a key slot 3 wherein a key 4 may be inserted. The cylinder 1 has a pair of obstruction borings 5 and 6 in which are slidably mounted a pair of obstruction pins 7 and 8. The cylinder 1 also has a cylinder boring 9 wherein is mounted a cylinder pin 10. The boring 9 is generally perpendicular to the borings 5 and 6.

The obstruction pin 7 has a smaller diameter sensing shaft 7*a* and a large diameter body portion 7*b*. The sensing shaft 7*a* has a sensing surface 7*c*. The body member 7*b* has an external spherical surface 7*d*. The obstruction pin 8 has a corresponding set of members and surface. A sensing member 8*a* is connected to a body member 8*b*. The sensing member 8*a* has a sensing surface 8*c* and the body member 8*b* has an external spherical surface 8*d*.

The cylinder pin 10 has a reduced diameter key sensing pin 10*a* having a tapered sensing surface 10*b* which directly bears against a slot 11 of the key 4. The proper higher level key 4 has a pair of ribs 12 and 13 which are disposed generally perpendicular to the plane of the key 4 and have a width which is wide enough such that the sensing surfaces 7*c* and 8*c* of the obstruction pins 7 and 8 are pushed away from the cylinder pin 10 and toward the outer edges of the borings 5 and 6.

A spring-biased locking pin 15 is located in a boring 16 of the locking housing 2. The boring 16 is parallel to and lines up with the cylinder pin boring 9 when cylinder 1 is aligned properly for the key 4 to be inserted therein. The cylinder 1 has a peripheral surface 19 which lies adjacent to a corresponding surface 19*a* in the housing 2. The borings 5 and 6 have a pair of depressions 20 and 21 located at the ends of the borings 5 and 6 near the peripheral surface 19 of the cylinder 1. Associated with the cylinder pin 10 is a second partial cylinder pin 22. The pin 22 has a flat upper surface 24 and a hemispherical lower surface 26. The surface 26 intersects a flat surface 28 of the locking pin 15. The flat surface 24 of the partial cylinder pin 22 intersects a hemispherical surface 30 of the cylinder pin 10. Both the hemispherical surface 30 and the hemispherical surface 26 have a radius of curvature corresponding to the radius of curvature of the external peripheral 19 of the cylinder 1.

FIG. 1 discloses the condition of the lock when a high order key 4 has been inserted into the slot 3. The ribs 12 and 13 of the key 4 have driven the obstruction pins 7 and 8 toward the outer peripheral 19 of the cylinder 1 so that the external surfaces 7*d* and 8*d* correspond at least in part to the peripheral surface 19 of the cylinder 1. Further, the key 3 has caused the cylinder pin 10 to be offset by a groove 32 which is the innermost point of the groove 11 displacing the tapered surface 10*b* of the member 10*a* a predetermined amount such that the surface 30 of the cylinder 10 now is aligned with the external peripheral surface 19 of the cylinder 1. In this condition, the second cylinder pin 22 has been driven into the boring 16 and in turn has depressed the spring-biased locking pin 15 further in the boring 16. The two-part cylinder pin 10 and 22 has been properly displaced so as to equalize the unlocking pin 15 hence, if other cylinder pins have properly equalized other locking pins in the lock, the cylinder 1 may now be rotated.

When the cylinder 1 is rotated in either direction an amount corresponding to approximately 90° the external surfaces 7*d* or 8*d* of the obstruction pins 7 or 8 will be in contact with the flat surface 24 of the cylinder pin 22. The spring-biased locking pin 15, because of the spring-bias which has not been shown, will attempt to drive the cylinder pin 22 into the boring 5 or 6, depending on which way the cylinder pin 1 has been rotated. However, because of the ribs 12 or 13, bearing against the sensing surface 7*c* and 8*c* of the obstruction pins 7 and 8, the pins 7 and 8 will not be allowed to move thereby blocking the cylinder pin 22 and the locking pin 15 from entering the boring 5 or 6. As a result, the cylinder may be rotated fully and the lock opened.

Figure 1A:
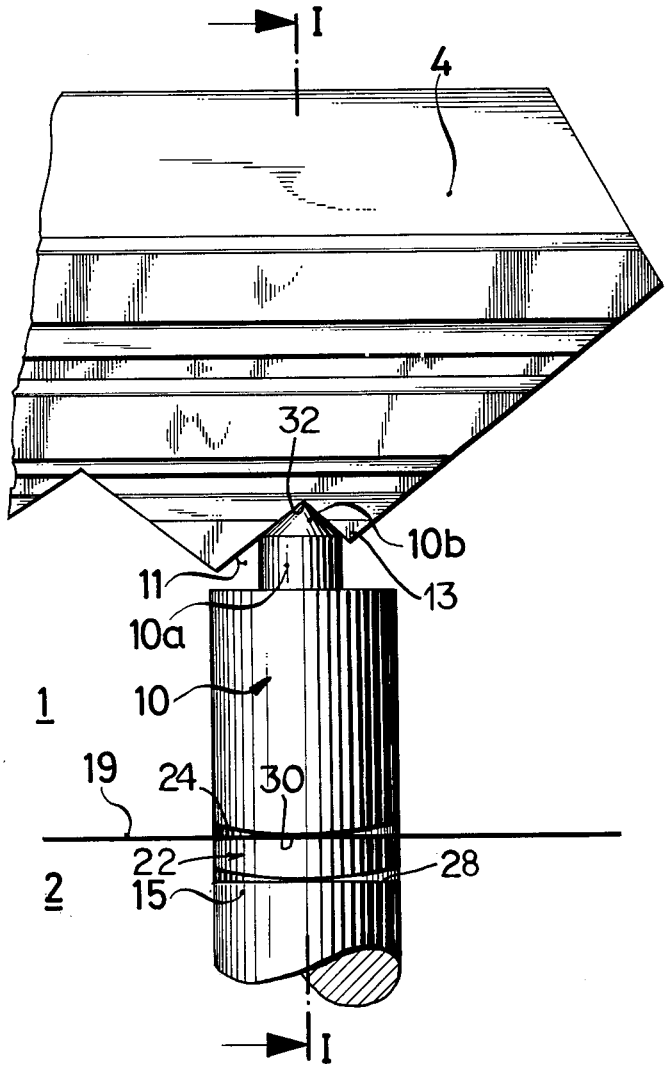
FIG. 1*a* is a section taken along line Ia—Ia showing a key properly displacing a cylinder pin.

FIG. 1*a* discloses the relationship between the cylinder pin 10 and the higher level key 4. The notch 32 has caused the pin 10 to be displaced a predetermined amount such that the surface 30 of the pin 10 is aligned with the external peripheral surface 19 of the cylinder 1. The rib 13 against which the sensing surface 8*c* of the sensing member 8*a* bears is also shown.

Figure 2:
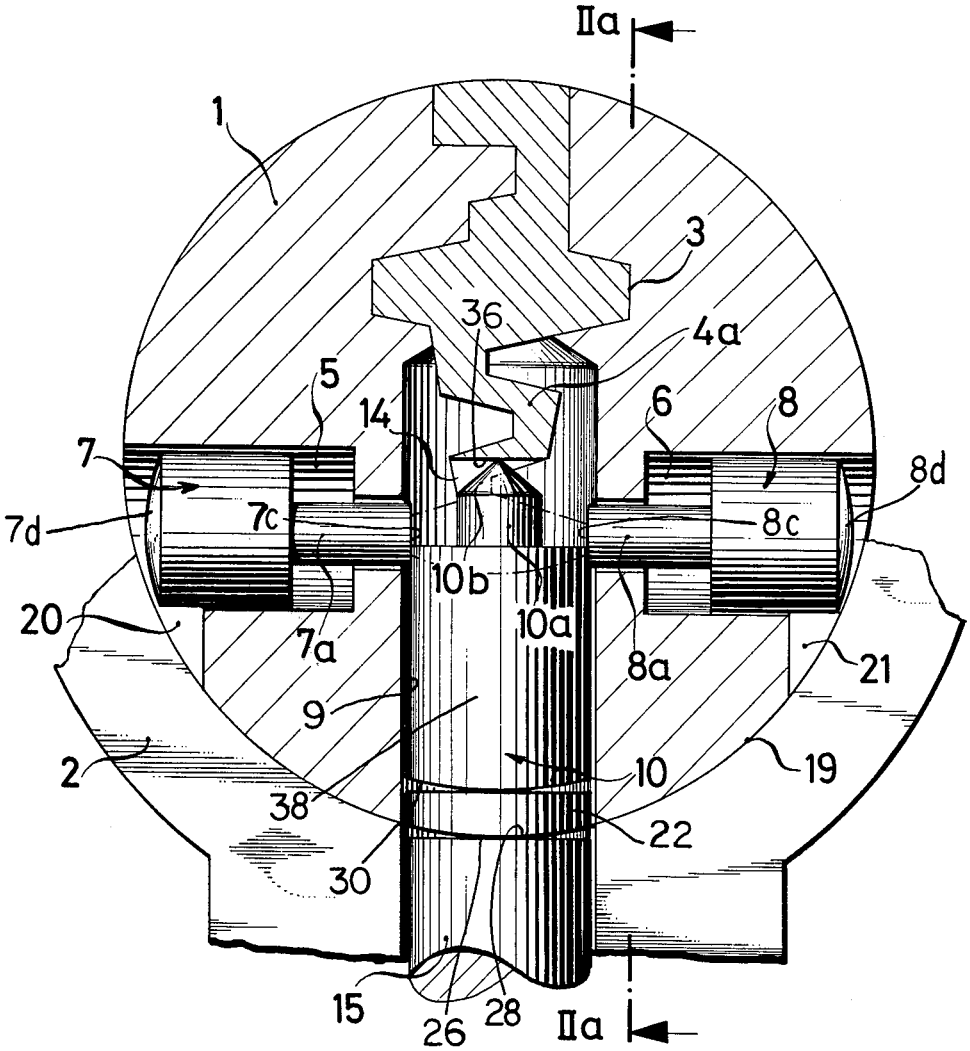
FIG. 2 is an enlarged partial section of a typical cylinder showing a subordinate key in section having displaced the two part cylinder pin so that the cylinder may rotate and having displaced the obstruction pins so that the cylinder will not be blocked.

FIG. 2 discloses the same lock housing 2 and cylinder 1 as was disclosed in FIG. 1. However, in FIG. 2, a key 4*a* has been inserted into the slot 3. The key 4*a* is a subordinate key and is designed to open fewer locks than the key 4 of FIG. 1. When the key 4*a* is inserted into the key channel 3, it does not contain the ribs 12 and 13 that were found on the high order key 4. The ribs 12 and 13 have been eliminated from the key 4*a* by providing a deep notch 14 having a point 36 into which the tapered surface 10*b* of the cylinder pin 10 slides. Thus, as may be seen from FIG. 2, the cylinder pin 10 under the action of the spring-biased locking pin 15 rises higher into the cylinder bore 9 when the subordinate key 4*a* has been inserted into the key channel 3 than when the higher order key 4 has been inserted into the key channel 3. In order that the subordinate key 4*a* may unlock the cylinder 1, the second cylinder pin 22 is utilized. The presence of the second cylinder pin 22 between the primary cylinder pin 10 and the spring-biased locking pin 15 is to provide a second displacement corresponding to the surface 26 of the cylinder pin 22 which is aligned with the external peripheral 19 of the cylinder 1, at which the cylinder 1 may be unlocked and rotated.

Because the subordinate key 4*a* does not have the ribs 12 and 13 as does the higher order key 4, an alternate means must be found to properly displace the obstruction pins 7 and 8. The housing pin 10 has a body portion 38 whose diameter corresponds to the width between the outside surfaces of the ribs 12 and 13 of the key 4. Thus, as the cylinder pin 10 rises in the boring 9 as indicated in FIG. 2, the sensing surfaces 7*c* and 8*c* of the obstruction pins 7 and 8 bear against the surface of the body member 38 of the cylinder pin 10. As a result, the external spherical surfaces 7*d* and 8*d* of the obstruction pin 7 and 8 once again correspond to the external peripheral surface 19 of the cylinder 1. When the cylinder pin consisting of the parts 10 and 22 has been properly displaced as indicated in FIG. 2 and the cylinder 1 is rotated either direction approximately 90°, the surfaces 7*d* and 8*d* will contact the surface 28 of the spring-biased locking pin 15 at a point corresponding to the external periphery 19 of the cylinder pin 1 thereby preventing the spring-biased pin 15 from dropping into the grooves 20 and 21 along with the borings 7 and 8. The lock may then be fully unlocked without interference from the locking pin 15.

Figure 2A:
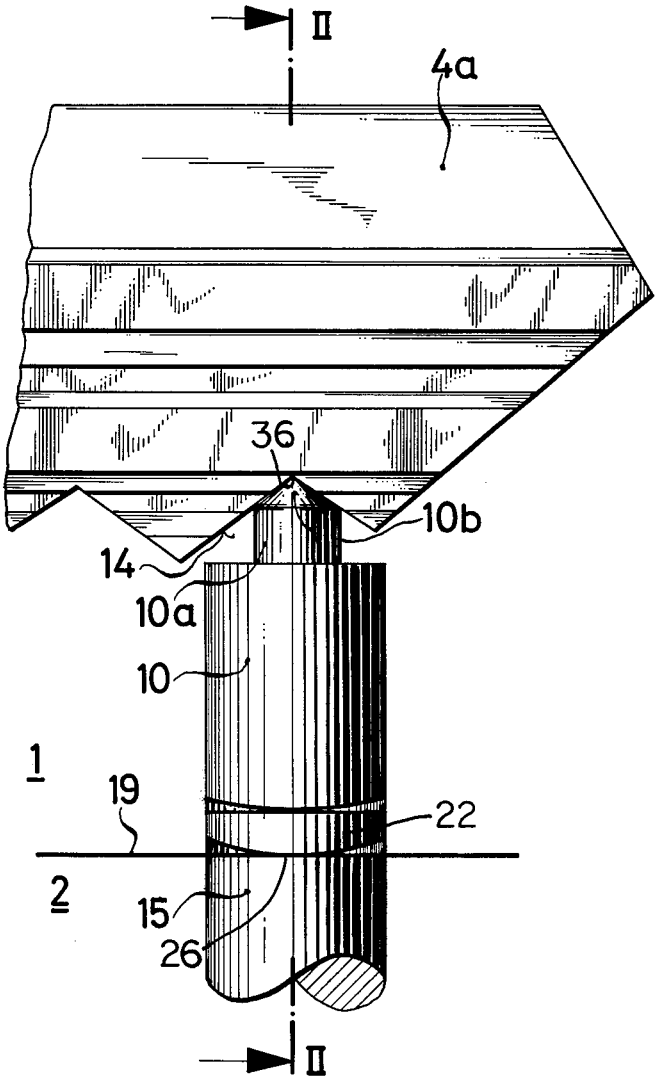
FIG. 2*a* is an enlarged partial section taken along the line IIa—IIa showing a side view of a subordinate key having properly displaced the two part cylinder pin.

FIG. 2*a* discloses the key 4*a* with the notch 14 with the high point 36 into which the tapered end 10*b* of the pin 10 slides. The additional displacement of the cylinder pin 10 to include the cylinder pin 22 so that the lower spherical surface 26 of the cylinder pin 2 coincides with the external peripheral surface 19 of the cylinder 1 is also shown.

Figure 3:
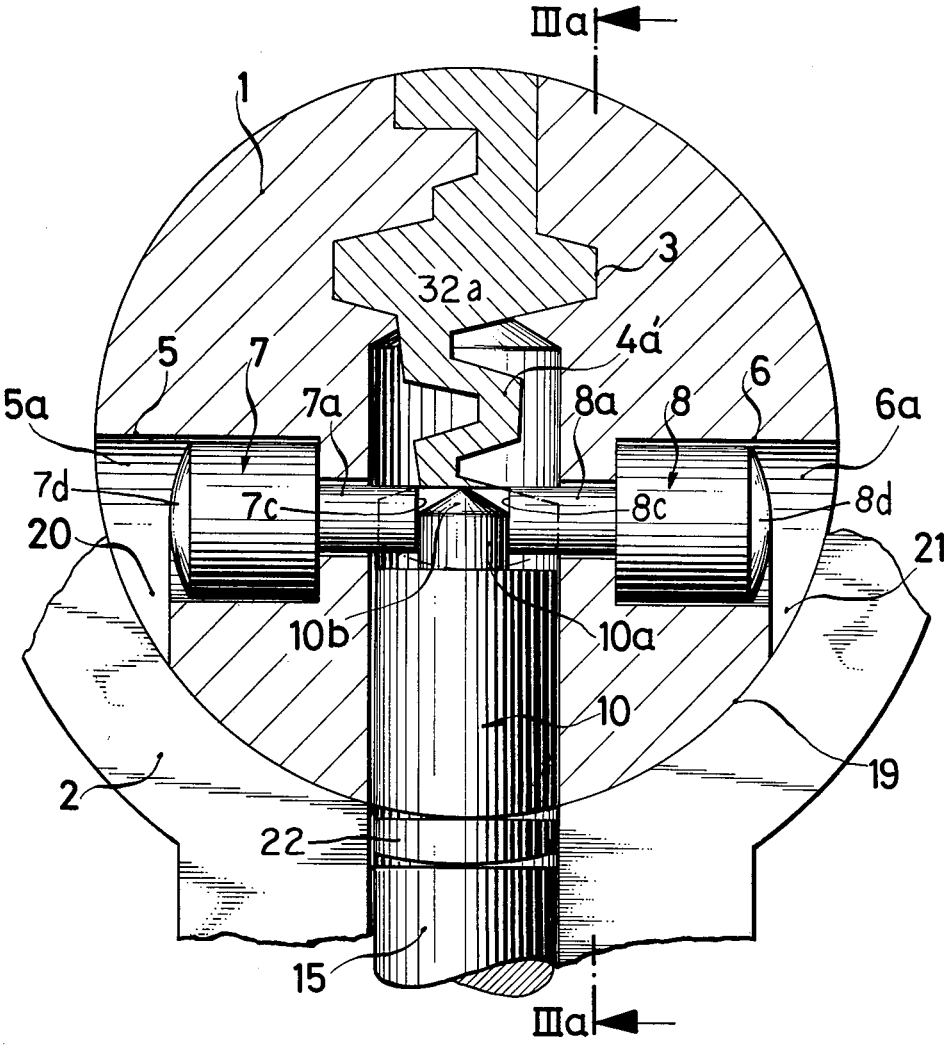
FIG. 3 is an enlarged partial section with an altered key shown in section having properly displaced the cylinder pin but improperly displaced the obstructing pins.
Figure 3A:
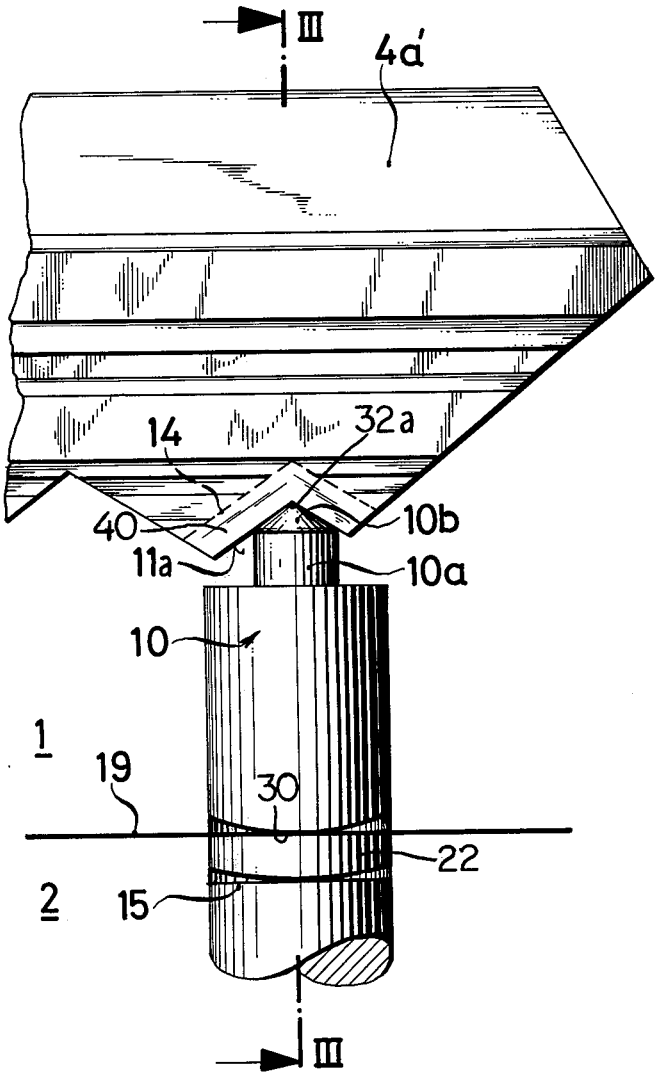
FIG. 3*a* is an enlarged partial section taken along the line IIIa—IIIa showing a side view of a subordinate key which has been altered to displace the cylinder pin an amount corresponding to the displacement produced by a higher level key.

FIG. 3 discloses a key 4*a*', a subordinate key which has been altered in an attempt to make it a higher order key, demonstrates why it is the present invention makes such a modification a practical impossibility. In order to create a higher order key such as the key 4 out of a subordinate key such as the key 4*a* both the depths of the groove in the key, such as the groove 14 of the key 4*a*, must be adjusted and further, the ribs 12 and 13 of the key 4 must be restored. With respect to FIG. 3*a*, the key 4*a*' has had the groove 14 rebuilt to correspond to the groove 11 of the key 4 by the addition of a strip of material 40. The strip of material 40 has reduced the depth of the groove 14 to that of a groove 11*a* which corresponds to the groove 11 of the key 4. The groove 11*a* has a high point 32*a* corresponding to the point 32 of the key 4. Because of the added material 40, the cylinder pin 10 is displaced a lesser amount than is the case for the key 4*a*. In fact, as can be seen in FIGS. 3 and 3*a*, the cylinder pin 10, due to the addition of the material 40, has been displaced an amount corresponding to the amount that the key 4 would displace the cylinder pin 10. As a result, the surface 30 of the cylinder pin 10 is aligned with the external peripheral surface 19 of the cylinder 1. Assuming all of the other cylinder pins are properly aligned, the cylinder 1 would be free to turn. However, as can be seen with respect to FIG. 3, the sensing surfaces 7*c* and 8*c* bear not against the ribs 12 and 13 of the key 4, but bear against the surface of the cylinder 10*a* of the cylinder pin 10. Thus, the external spherical surfaces 7*d* and 8*d* of the obstruction pins 7 and 8 are not displaced so as to correspond to the external peripheral surface 19 of the cylinder 1. As a result, when the cylinder 1 is rotated in either direction the cylinder pin 22 and the spring-biased locking pin 15 will enter the depressions 20 or 21 at the ends 5*a* and 6*a* of the borings 5 or 6. When the spring-biased locking pin 15 enters the end 5*a* or 6*a* of the boring 5 or 6 it will thereby block any further rotation of the cylinder 1 even though the displacement of the cylinder pin 10 has been such to unlock the cylinder and permit partial rotation thereof.

Thus, in order to create a higher level key from a subordinate key not only is it necessary to reduce the depth of the groove such as the groove 14, of the subordinate key 4*a*, but it is also necessary to restore the ribs such as the ribs 12 and 13 of the key 4 in order to properly displace the obstruction pins 7 and 8. Both of these steps require an addition of material to the subordinate key 4*a*. This is much more difficult to carry out then is a removal of material from the key 4*a* as could be done with the prior art systems. Because of the two steps required to convert a subordinate key to higher order key utilizing the present invention, such conversion as a practical matter is almost impossible.

It should be noted that while the above enumerated FIGS. 1 through 3 disclose the invention utilized with respect to a selected cylinder pin, obstruction pins such as the pins 7 and 8 may be incorporated and utilized with one or more cylinder pins thereby requiring a key having a complex ridge structure. It should also be noted, that within any given level of key, the ordinary differentiation between one cylinder pin and another may be utilized to provide a large number of different keys at the same level. Finally, the cylinder bore 9 has been shown perpendicular to the obstruction bores 5,6. The invention is not limited to a perpendicular relationship. Instead, an arrangement where the cylinder bore intersects the obstruction bores at an acute angle could also be used.

Although various modifications might be suggested by those skilled in the art, it should be understood that I wish to embody within the scope of the patent warranted hereon all such modifications as reasonably and properly come within the scope of my contribution to the art.

I claim:

1. An improved cylinder lock for use with a hierarchical key system having a cylinder rotatably mounted in a housing, a radial boring in the cylinder which is alignable with a boring of substantially the same diameter in the housing, a cylinder pin located in the cylinder housing and capable of limited radial movement therein, a spring-biased locking pin positioned within the housing bore, operable to displace the cylinder pin and move partially into the cylinder pin bore thereby locking the cylinder; a pair of obstruction borings selectively located at an angle with respect to the cylinder pin boring and which open onto the cylindrical surface of the cylinder, an obstruction pin mounted in each of the obstruction borings, a key slot in the cylinder wherein a key may be inserted to displace the cylinder pin and the obstruction pins a predetermined amount thereby unlocking the lock and permitting the cylinder to rotate and unlock the lock;

the improvement comprising:

an improved cylinder pin comprising a first and a second member; said first member having a first and a second end, said first end having a sensing member disposed so that the grooves in a key inserted into the key slot may be sensed, said sensing member having a smaller diameter than said first member, said second end having a curvature corresponding to the curvature of the cylinder; said second member having a generally cylindrical shape with a first end having a flat surface and a second end having a curvature corresponding to the curvature of the cylinder, said second member being located between said first member and the spring biased locking pin with said second, curved surface of said first member adjacent to said first, straight, surface of said second member and said second, curved, surface of said second member adjacent to the spring biased locking pin;

the obstruction pins each comprising operative rib sensing surfaces whereby;

when a higher level key is inserted into the key slot, said sensing surfaces of said obstruction pins sense ribs on the key of a predetermined width which displace said obstruction pins a predetermined distance thereby closing the ends of the obstruction bores which open onto the cylindrical surface of the cylinder and said sensing member senses the depth of the selected groove cut into the key thereby displacing said first member so that said curved second surface of said first member displaces said second member into the housing boring thereby unlocking the cylinder and permitting rotation thereof to unlock the lock;

when a lower level key is inserted into the key slot, said sensing surfaces of said obstruction pins do not sense ribs on the key as the lower level keys have had the ribs removed by cutting a deep groove into the key coincident with the location of the ribs of the higher order key, the deep groove sensed by said sensing member of said first member permits said first and second members to be radially displaced a preselected distance such that said second surface of said second member is located so as to prevent the locking pin from entering the cylinder bore and such that said first member displaces said obstruction pins to close the obstruction bores thereby permitting the cylinder to rotate and open the lock.

2. The improved lock according to claim 1 wherein each of said obstruction pins comprises a cylindrically shaped body member having a first diameter with a cylindrically shaped second sensing member having a second diameter less than said first diameter with said rib sensing surface located at one end thereof.

3. The improved lock according to claim 1 wherein said obstruction bores are oriented at an angle substantially 90° with respect to said cylinder bore.

4. An improved cylinder lock for use with a hierarchical key system having a cylinder rotatably mounted in a housing, a radial boring in the cylinder which is alignable with a boring of substantially the same diameter in the housing, a cylinder pin located in the cylinder housing and capable of limited radial movement therein, a spring-biased locking pin positioned within the housing bore, operable to displace the cylinder pin and move partially into the cylinder pin bore thereby locking the cylinder; an obstruction boring selectively located an angle with respect to the cylinder pin boring and which opens onto the cylindrical surface of the cylinder, an obstruction pin mounted in the obstruction boring, a key slot in the cylinder wherein a key may be inserted to displace the cylinder pin and the obstruction pin a predetermined amount thereby unlocking the lock and permitting the cylinder to rotate and unlock the lock;

the improvement comprising:

an improved cylinder pin comprising a first and a second member operatively located in the cylinder bore;

an improved obstruction pin comprising an operative rib sensing surface whereby;

when a higher level key is inserted into the key slot, said sensing surface of said obstruction pin sense a rib on the key of a predetermined width which displaces said obstruction pin a predetermined distance thereby closing the end of the obstruction bore which opens onto the cylindrical surface of the cylinder and said improved cylinder pin senses the depth of the selected groove cut into the key thereby displacing said first member so that said first member displaces said second member into the housing boring thereby unlocking the cylinder and permitting rotation thereof to unlock the lock;

when a lower level key is inserted into the key slot, said sensing surface of said obstruction pin does not sense a rib on the key as the lower level keys have had the rib removed by cutting a deep groove into the key coincident with the location of the rib of the higher order key, the deep groove sensed by said first member permits said first and second members to be radially displaced a preselected distance such that said second member is located so as to prevent the locking pin from entering the cylinder bore and such that said first member displaces said obstruction pin to close the obstruction bore thereby permitting the cylinder to rotate and open the lock.

5. The improved lock according to claim 4 wherein said first member comprises:

a cylindrically shaped body member of a selected length having a pin member affixed to one end thereof; said pin member being operable to sense the selected grooves out into the key.

6. A method of opening a lock based on a hierarchical key system, the lock having a cylinder rotatably mounted in a housing with a cylinder bore and having a two-part cylinder pin positioned therein: a housing bore having a spring loaded locking pin positioned therein, at least one obstruction bore located at an angle with respect to the cylinder bore with an obstruction pin located therein having a key sensing surface thereon and a key slot located in the cylinder such that a key inserted into the slot may be sensed by the cylinder pin and by the obstruction pin; a key for use with the lock having an operatively located slot of a preselected depth and having a set of ribs of a preselected width located adjacent to the slot; a lower order key having a deeper slot and having no ribs in the immediate area of the slot;

the method comprising the steps of:

sensing the presence of a key in the lock;

displacing the cylinder pin by a first amount of by a second amount respectively, depending on whether a higher level or a lower level key has been sensed;

sensing the presence or absence of ribs on the key;

displacing the obstruction pin a selected distance based on the width of the ribs of a higher order key or based on the radius of the cylinder pin if a lower order key is sensed;

closing the obstruction pin bore thereby preventing the locking pin from entering the obstruction pin bore;

rotating the cylinder to unlock the lock.

* * * * *